US005911167A

United States Patent [19]

Jones et al.

[11] Patent Number: 5,911,167

[45] Date of Patent: Jun. 8, 1999

[54] PIANO ESCAPEMENT ACTION

[75] Inventors: Scott Jones, Port Washington, N.Y.; Stefan Knupfer, Hamburg, Germany

[73] Assignee: Steinway, Inc., Waltham, Mass.

[21] Appl. No.: 08/816,208

[22] Filed: Mar. 12, 1997

Related U.S. Application Data

[63] Continuation of application No. 08/616,656, Mar. 15, 1996, abandoned, which is a continuation-in-part of application No. 08/341,521, Nov. 17, 1994, Pat. No. 5,511,454.

[51] Int. Cl.[6] ..... G10C 3/18

[52] U.S. Cl. ..... 84/236; 84/243

[58] Field of Search ..... 84/236, 241, 242, 84/243, 247, 248, 249

[56] References Cited

U.S. PATENT DOCUMENTS

| | | | |
|---|---|---|---|
| 3,169,436 | 2/1965 | Smith | 84/243 |
| 4,854,211 | 8/1989 | Tanaka et al. | 84/240 |
| 5,511,454 | 4/1996 | Jones et al. | 84/236 |

FOREIGN PATENT DOCUMENTS

| | | |
|---|---|---|
| C-96 578 | 3/1898 | Germany . |
| C-224 240 | 7/1910 | Germany . |
| 41-19810 | 9/1941 | Japan . |

*Primary Examiner*—William M. Shoop, Jr.
*Assistant Examiner*—Shih-yung Hsieh
*Attorney, Agent, or Firm*—Fish & Richardson P.C.

[57] ABSTRACT

A knuckle assembly for an escapement action of a piano includes a knuckle, a jack retainer, and an adjustment means acting between the retainer and the knuckle for positioning the retainer relative to the knuckle. The knuckle assembly is mountable between first and second ends of a hammershank. The knuckle defines a knuckle surface for engagement with a jack. The knuckle is arranged for escape of the jack from engagement with the knuckle surface during depression of a piano key. The retainer retains the jack in an "at rest" position with the jack in engagement with the knuckle surface in opposition to force of a spring urging the jack toward the "at rest" position. A piano escapement action assembly includes a hammershank, a knuckle assembly, a jack engaged with a knuckle surface in an "at rest", and a spring disposed to urge the jack toward the "at rest" position.

20 Claims, 15 Drawing Sheets

130
132
136
150
150

130
278
134
13A
13A
150
270
272
274
276
280
282
150
270

134
12A
12A
150
260
264
262
262
260

PIANO ESCAPEMENT ACTION

This is a continuation of application Ser. No. 08/616,656, filed Mar. 15, 1996, now abandoned, which is a continuation-in-part of application Ser. No. 08/341,521 filed Nov. 17, 1994, now issued as U.S. Pat. No. 5,511,454.

BACKGROUND OF THE INVENTION

This invention relates to pianos.

When a pianist presses upon a piano key, the motion of the key is transmitted to a hammer, which in turn strikes against a tensioned string, to produce sound. The traditional assemblage of levers, pivots, springs and pads that translates key notion into hammer motion, allows the hammer to rebound after striking the string, and further allows for rapid repetition of notes is called a double escapement action.

FIGS. 1/1A through 3/3A demonstrate operation of a prior art double escapement piano action 100. For the purpose of better understanding, with reference to FIGS. 1 and 1A, the following components remain stationary with respect to the piano during a sequence of key depression through hammer strike and return: hammershank flange 134, hammershank flange center pin 136, repetition support center pin 112, key fulcrum 104, key pin 106, drop regulation screw 196, jack let-off button 170 and string 140.

Still referring to FIGS. 1 and 1A, the prior art piano double escapement action 100 is shown in the "at rest" position. Wooden key 102, approximately 15 inches long, is mounted to pivot on felt-covered, wooden fulcrum 104 and brass pin 106 extending through a vertical slot (not visible in the figures) in key 102. Repetition support 110 is mounted for rotation about metal center pin (a fixed pivot point) 112. Two levers are mounted to rotate independently within the repetition assembly: an L-shaped jack 120 (also known as a "fly") mounted to rotate about center pin 121, and repetition lever 123 mounted to rotate about center pin 114. Felt hammer 130 is fixedly mounted at the free end of wooden shank 132 (shown also in FIGS. 7 and 7A), and wooden shank 132 is mounted to rotate about center pin 136, held stationary by flange 134. As the hammer 130 is rotated upwardly, it strikes tensioned piano string 140 to create vibration and sound. Affixed to hammershank 132, between hammer 130 and center pin 136, is buckskin covered cylindrical knuckle 150, engaged upon the top end surface 128 of the upper arm 122 of the jack 120.

The jack 120 is maintained in the "at rest" position shown in FIGS. 1 and 1A by action of a lower end of return spring 160, which bears against the rear surface 129 of the jack, thus urging it to rotate backward (counter-clockwise in the drawings), about center pin 121, until the felt regulating button 162 (mounted on the upper jack arm 128) is brought into contact with the rigid metal spoon 164 (mounted to repetition support 110). The upper end of return spring 160 biases the forward end of repetition lever 123 to rotate upwardly, about center pin 114, until the pad 166, mounted at the opposite end of repetition lever 123 is brought into contact with the repetition support 110.

We refer next to FIGS. 2 and 2A (in which the position of the action 100 in the "at rest" position of FIG. 1A is indicated in dashed line for ease of reference). Upon depression of the key 102 (indicated by arrow 180), repetition support 110 is moved upwardly, to rotate (arrow 182) around center pin 112, thereby actuating the various interengaged elements of the repetition assembly (i.e. repetition support 110, jack 120, repetition lever 123, spring 160, regulating button 162 and spoon 164) and moving the hammer 130 towards striking engagement with the piano string 140. In particular, movement of the jack 120 urges the knuckle 150 upward and to the left (in the drawings), causing the hammershank 132 to rotate about center pin 136, driving the hammer 130, at the free end of the hammershank, upward and to the left, toward the piano string 140 (arrow 184). During movement of the knuckle 150 upward and to the left, the engagement of the knuckle surface with the top end surface 128 of the jack 120 creates excessive friction, which has the recognized consequence of requiring a pianist to apply additional force in order to achieve the desired key depression. In order to minimize this undesirable condition, it has been known to apply lubricant to the opposed top end surface 128 and the surface of knuckle 150, and/or to insert one or more lead counterweights 172 into the front portion of key 102. Approximately midway through full depression of the key 102, the outer end of the lower arm 126 of jack 120 is brought into engagement with stationary let off button 170.

Referring now to FIGS. 3 and 3A (in which the position of the action 100 in FIG. 2A is indicated in dashed line for reference), as key depression continues (indicated by arrow 180), engagement of the jack lower arm 126 with stationary let off button 170 causes the jack 120 to rotate in a clockwise direction, about pin 121. This rotation causes the top end surface 128 of the upper arm 122 of the jack 120 to move forward (to the right in the drawings, indicated by arrow 190), escaping from beneath the surface of the knuckle 150. Movement of the hammer 130 continues upward with rotation of hammershank 132 about pin 136, with the hammer striking the tensioned piano string 140 and then rebounding downward (arrow 192), to lodge against the opposed surface of back check 194.

When the key is released, the elements of the repetition assembly (i.e., repetition support 110, jack 120, repetition lever 123, spring 160, regulating button 162 and spoon 164) return toward the "at rest" position of FIGS. 1 and 1A, by the combined effect of gravity and the force of spring 160 acting through repetition lever 123 against stationary drop regulation screw 196 and knuckle 150. Engagement of hammer 130 with back check 194 holds the hammer in a slightly elevated position, allowing the top end surface 128 of the jack 120 to move quickly, under the urging of spring 160 upon jack 120, back (left in the drawings) to its "at rest" position under knuckle 150, with the regulating button 162 engaged against spoon 164. Upon return of all of the action components to the "at rest" position, a full keystroke is complete.

SUMMARY OF THE INVENTION

The invention is a double escapement piano action in which key movement rotates a jack/repetition lever assembly upward into a hammer/hammershank/knuckle assembly. This assembly, in turn rotates upward propelling the hammer into a tensioned string. The jack is held in its correct position beneath the knuckle by either a moveable or deformable jack retainer rather than a conventional rigid spoon. The jack retainer permits rotation of the jack within the repetition assembly during an initial portion of the action movement, therefore, the jack is free to follow the arcuate path of the knuckle, prior to escapement, in both the vertical and horizontal directions. This coupling motion reduces friction between the jack top surface and the knuckle lower surface.

According to one aspect of the invention, a knuckle assembly for an escapement action of a piano includes a knuckle, a jack retainer, and an adjustment means acting between the jack retainer and the knuckle for positioning the jack retainer relative to the knuckle. The knuckle assembly is mountable between a first end of a hammershank mounted to pivot relative to the piano and a second end of the hammershank carrying a hammer to strike a tensioned string of the piano. The knuckle defines a knuckle surface for engagement with a jack having a first portion extending from a pivot connection with a repetition support. The repetition support bears against a key of the piano and is mounted to pivot relative to the piano in response to depression of the key. The knuckle is arranged for escape of the jack from engagement with the knuckle surface during depression of a piano key. The jack retainer retains the jack in an "at rest" position with the jack in engagement with the knuckle surface in opposition to force of a spring urging the jack toward the "at rest" position.

According to another aspect of the invention, a piano escapement action assembly includes a hammershank; a knuckle assembly; a jack having a jack surface in engagement with a knuckle surface in an "at rest" position, the jack being arranged relative to the knuckle and to a key of the piano to convey motion of the key to the knuckle, and to disengage the jack surface from the knuckle surface during depression of the key; and a spring disposed to urge the jack toward the "at rest" position. The jack retainer position is adjustable to oppose the spring to retain the jack in the "at rest" position, and to allow the jack, in response to depression of the key, to move in a coupled rotary motion with the knuckle assembly prior to disengagement of the jack surface from the knuckle surface to allow the jack surface engaged with the knuckle surface to remain engaged with the knuckle surface during movement of the knuckle.

Preferred embodiments of these or other aspects of the invention may incorporate one or more of the following additional features. The adjustment means comprises an adjustment screw. The jack retainer includes a cushion surface positioned to retain the jack in the "at rest" position. The jack retainer is a flexible support member extending from the knuckle. The jack retainer and the knuckle are an integral component.

The piano escapement action includes a repetition support lever, a relatively rigid spoon mounted for movement with the repetition support lever, and a regulating button mounted for movement with the jack. The spoon and the regulating button are disposed at spaced apart positions in the "at rest" position of the jack. The repetition support lever has a first predetermined arc of travel about a first center point and the jack retainer assembly has a second predetermined arc of travel about a second center point. The first and second predetermined arcs of travel are calculated relative to spacing between the first and second center points to avoid interference engagement.

The piano escapement action includes an adjustable regulating member mounted for movement between a first position allowing rotation and following of the jack, and a second position restricting movement of the jack prior to disengagement. In combination with the jack retainer, a rigid spoon and jack regulating button are adjustable to maintain a predetermined spacing therebetween during initial movement of the action, such spacing being an advantageous feature of the invention because subsequent adjustment can be used to alter the force required to depress a key.

The jack retainer is mounted to maintain a rolling point of engagement of the jack surface with the knuckle surface, thereby to minimize sliding friction between the jack surface and the knuckle surface during a portion of the movement of the action before disengagement.

Objectives of the invention include to provide an improved piano escapement action with lower friction between jack and knuckle surfaces to reduce unwanted noise commonly associated with these components, and also to allow reduction in size and/or number of lead weights, typically located in the front portion of the key, or to allow relocation of weights toward the center or fulcrum of the key, thereby to reduce the inertia in the key, facilitating greater key acceleration. Other objectives include to provide an improved piano escapement action in which the difference between force required for key depression and lifting force for key return is significantly less than present in prior art actions of similar design. Further objectives of the invention include to provide an improved piano escapement action that will permit easy manufacture of retrofit kits consisting of knuckle assemblies or jack retainer assemblies and relieved repetition levers for installation on most modern piano double escapement actions.

These and other features and advantages of the invention will be apparent from the following description of presently preferred embodiments, and from the claims.

BRIEF DESCRIPTION OF THE DRAWINGS

FIG. 24 is a side view, taken partially in section, of another embodiment of a piano escapement action of the invention, while

DESCRIPTION OF THE PREFERRED EMBODIMENTS

Figure 1:
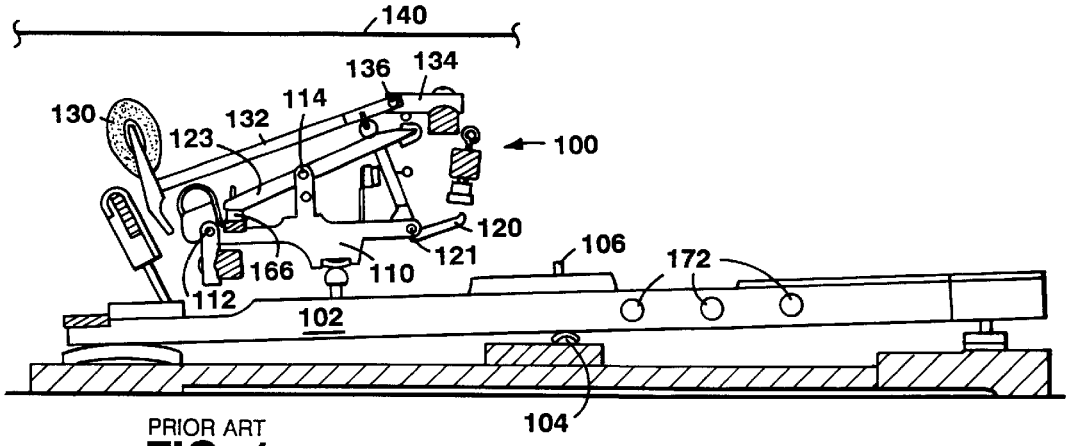
PRIOR ART FIG. 1
FIGS. 1, 2 and 3 are side views of a conventional prior art piano escapement action, showing, sequentially, movement of the action upon depression of a piano key.
Figure 1A:
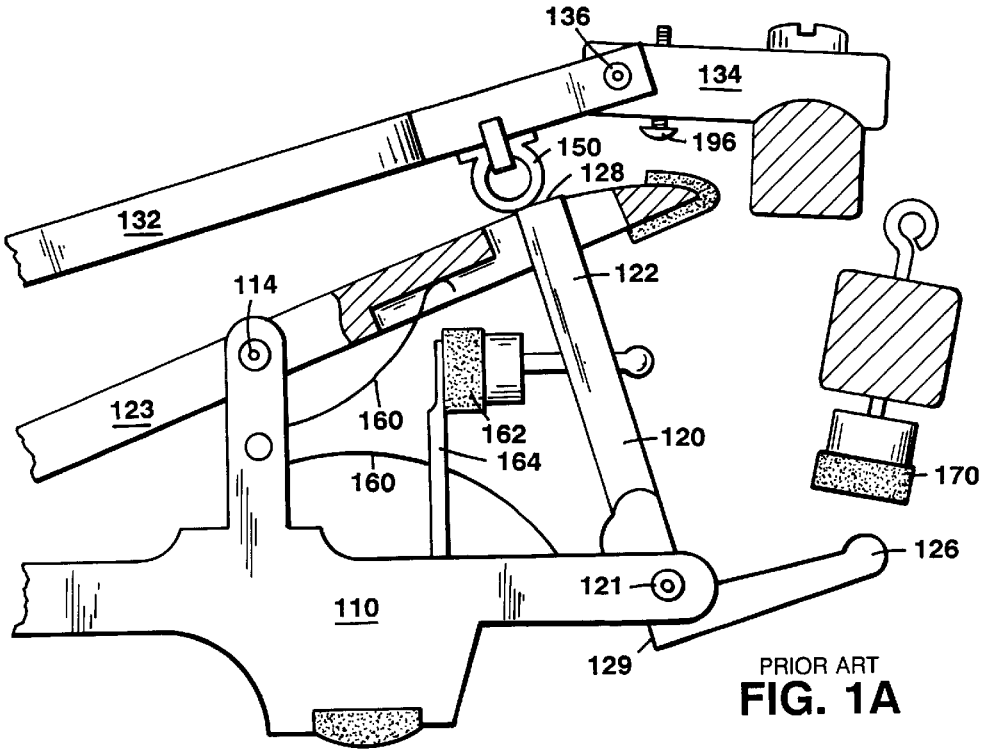
PRIOR ART FIG. 1A
FIGS. 1A, 2A and 3A are enlarged, detail side views, taken partially in section, of the conventional prior art piano escapement action of FIGS. 1, 2 and 3, respectively, with the prior positions of the action indicated in FIGS. 2A and 3A by dashed line, for ease of reference.
Figure 2:
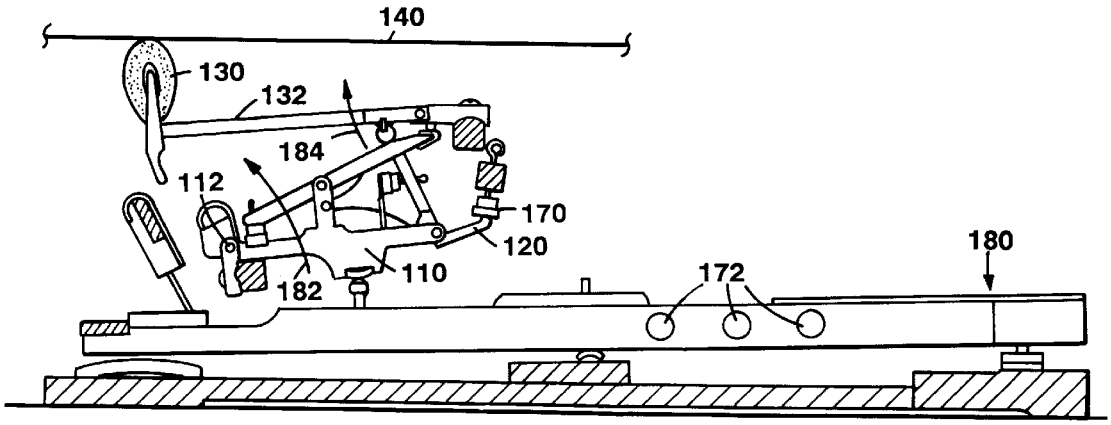
PRIOR ART FIG. 2
Figure 2A:
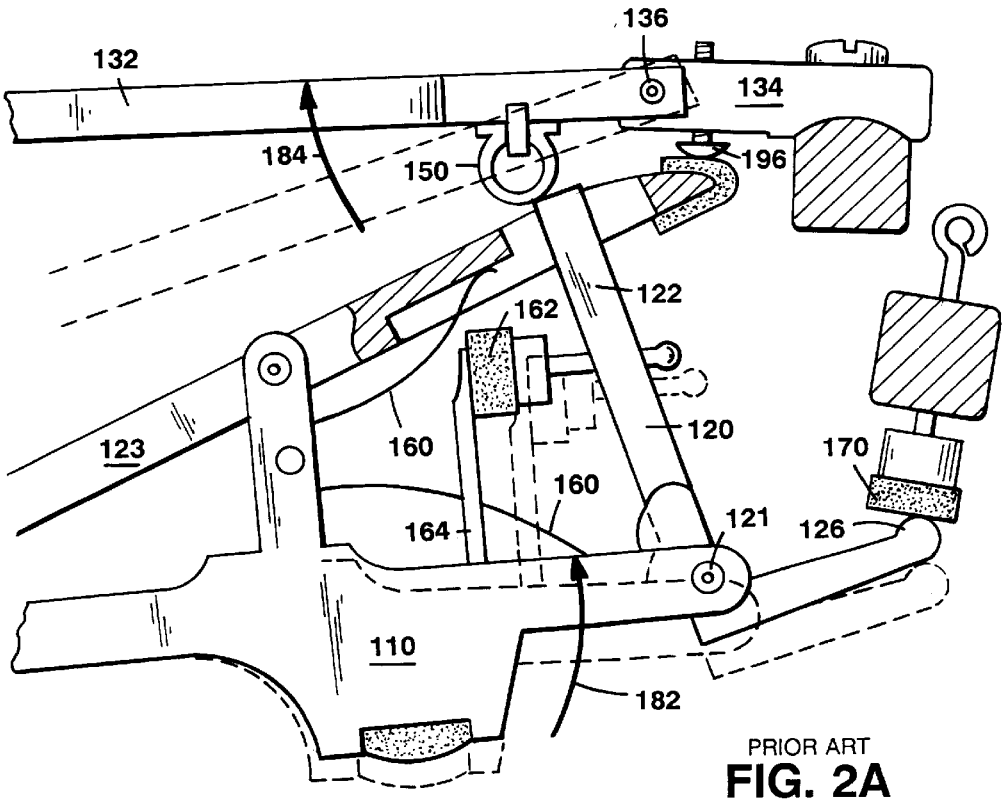
PRIOR ART FIG. 2A
Figure 3:
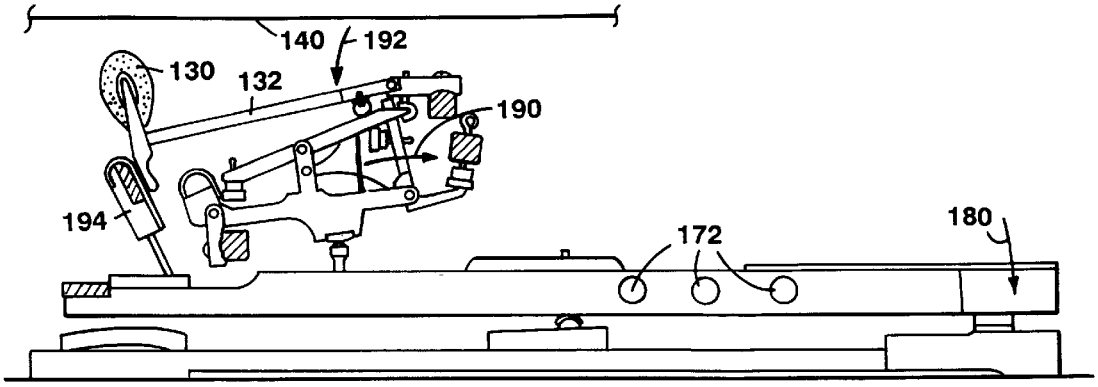
PRIOR ART FIG. 3
Figure 3A:
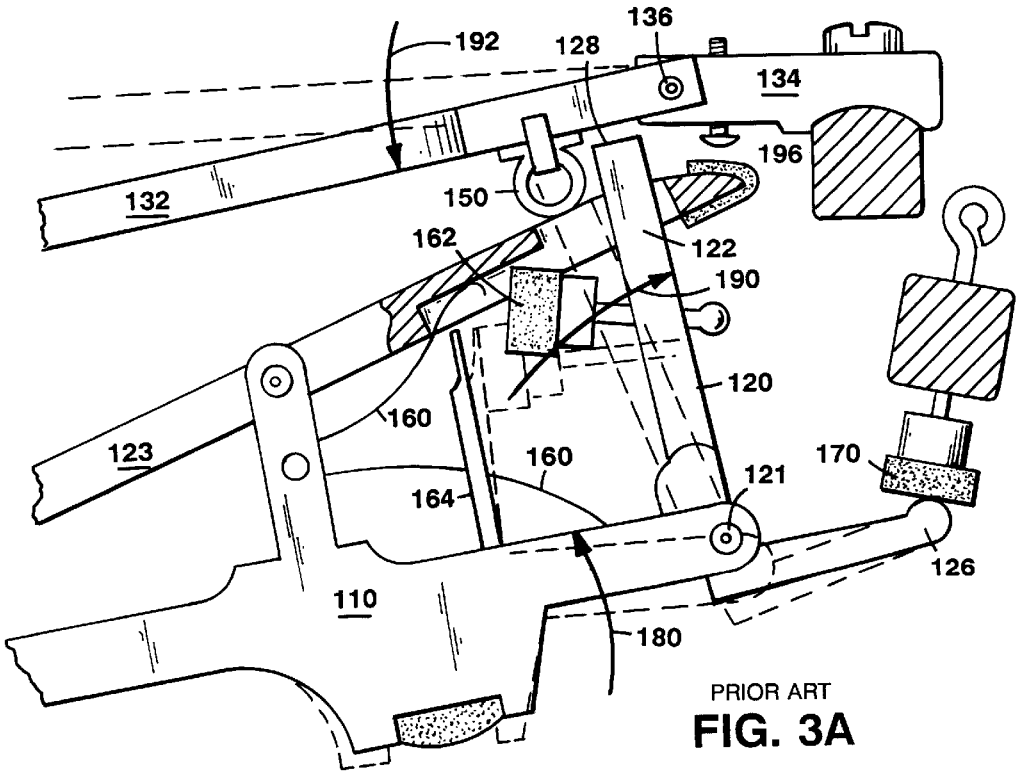
PRIOR ART FIG. 3A

An improved piano escapement action 200 of the invention, and its operation, will now be described with reference to the drawings, in which, for purposes of clarity and ease of understanding, elements having structure and function as in the prior art action 100 described above will be identified using the same reference numerals.

In the operation of the improved piano escapement action 200 of the invention, the jack 120 is free to follow the arcuate motion of the knuckle 150, with the top end surface 128 of the jack maintaining a rolling point of contact with knuckle 150 until the lower arm 126 of the jack contacts the stationary let off button 170.

Figure 4:
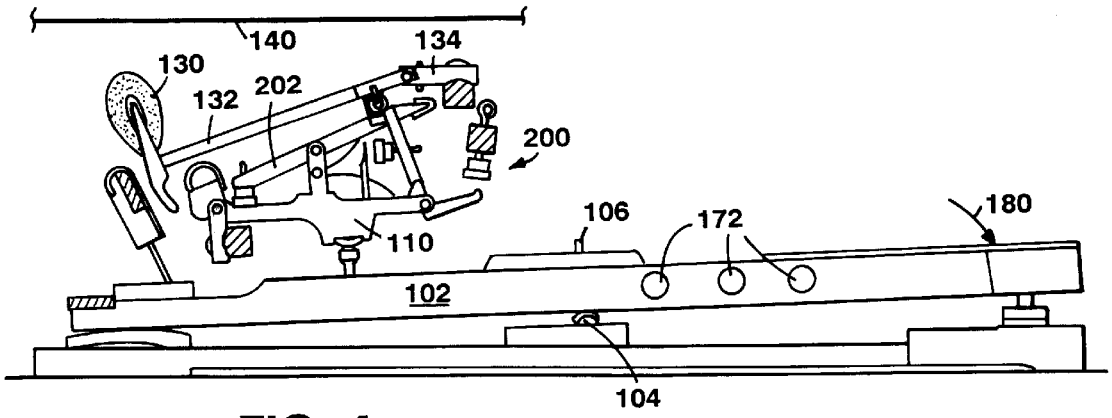
FIGS. 4, 5 and 6 are side views of a piano escapement action of the invention, showing, sequentially, movement of he action upon depression of a piano key.
Figure 4A:
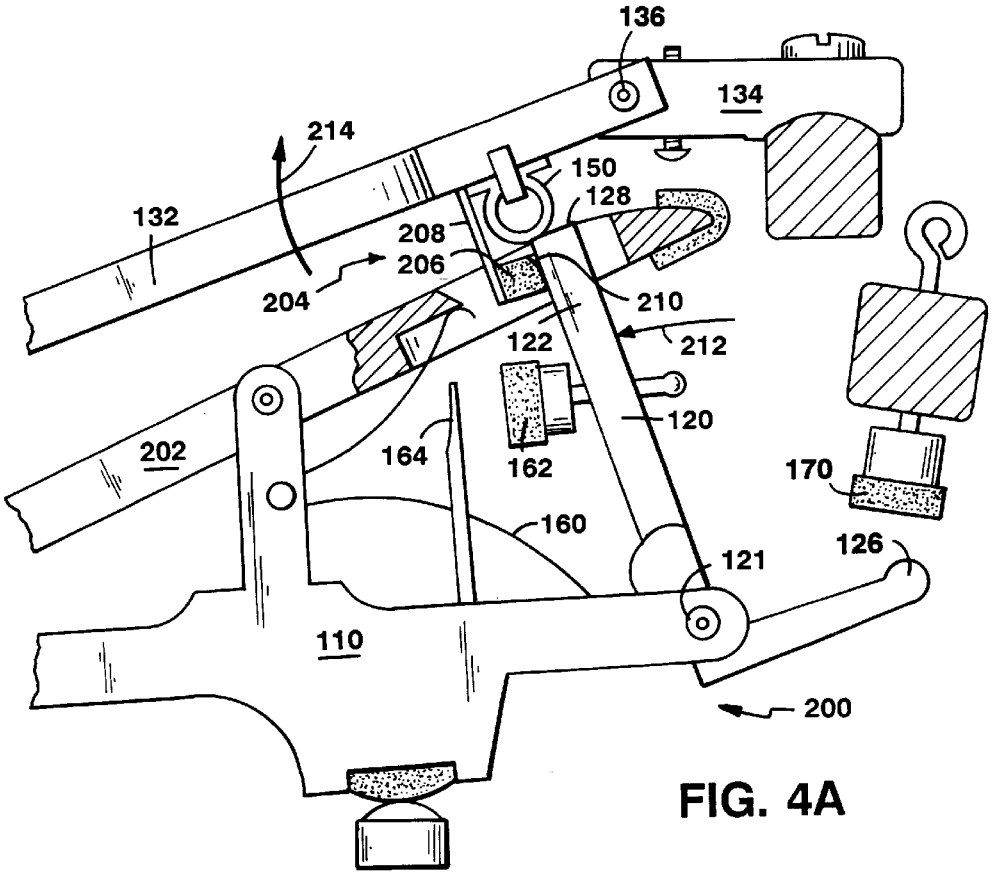
FIGS. 4A, 5A an 6A are enlarged, detail side views, taken partially in section, of the piano escapement action of FIGS. 4, 5 and 6, respectively, with the prior positions of the action indicated in FIGS. 5A and 6A by dashed line, for ease of reference.

Referring first to FIGS. 4 and 4A, an improved piano double escapement action 200 of the invention is shown in "at rest" position. As in the operation of a conventional prior art action (described above), when key 102 is depressed by a pianist (indicated by arrow 180), the key pivots on fulcrum 104 and key center pin 106. Movement of the key moves the repetition support 110, which in turn pivotally supports L-shaped jack 120 and repetition lever 202, and the hammer 130 at the end of hammershank 132 is moved to strike string 140 by rotation of the hammershank about pin 136 in stationary flange 134. Knuckle 150 supports the hammershank 132 by engagement upon the top end surface 128 of the upper arm 122 of jack 120. The "at rest" position of jack 120 is maintained by a return spring 160, which acts between jack 120 and the undersurface of repetition lever 202.

In the improved piano double escapement action 200 of the invention, a jack retainer assembly 204 consists of a jack retainer cushion 206 positioned below the knuckle 150 by rigid support member 208 extending from hammershank 132. The upper arm 122 of jack 120 is urged against the face surface 210 of jack retainer cushion 206 by action of spring 160 (as indicated by arrow 212). In this position, with the jack 120 held in the "at rest" position engaged upon retainer cushion 206, the regulating button 162 is held in an "at rest" position spaced from engagement with spoon 164. As a result, biasing force of spring 160 is redistributed from urging the regulating button 162 against the spoon 164 towards urging the upper arm 128 of the jack 120 against the retainer cushion 206 (arrow 212) which, in turn, applies a slight lifting force (arrow 214) to hammershank 132 carrying hammer 130. This lifting force, constantly applied to the hammer, reduces the inertia that must be overcome by a pianist applying his or her finger to set the hammer 130 into motion.

Figure 5:
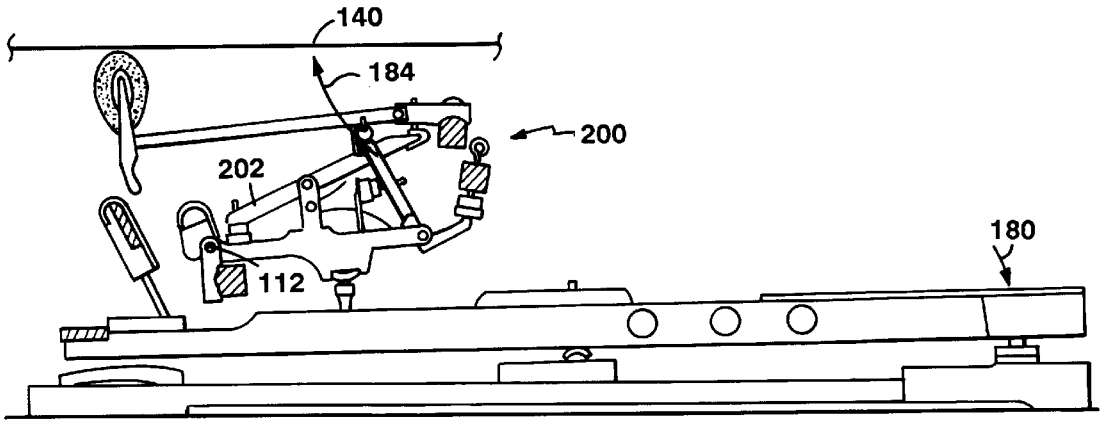
Figure 5A:
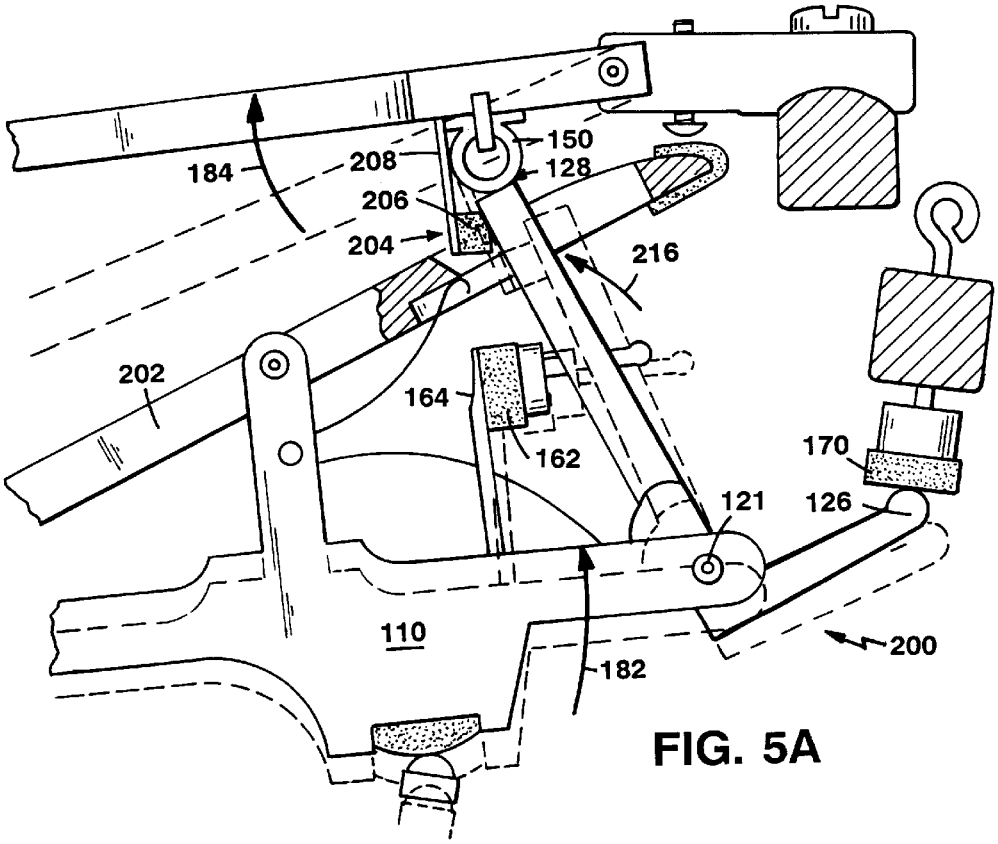

We refer next to FIGS. 5 and 5A (in which the position of the action 200 in the "at rest" position of FIG. 4A is indicated in dashed line for ease of reference). Upon depression of the key 102 (indicated by arrow 180), the repetition support 110 is moved upwardly, to rotate (arrow 182) the repetition assembly (i.e., repetition support 110, jack 120, spring 160, regulating button 162, spoon 164 and repetition lever 202) about stationary center pin 112, toward string 140. The top end surface 128 of jack 120 presses knuckle 150 upward, to urge the hammershank 132 and hammer 130 upward toward string 140 (arrow 184). In FIGS. 5 and 5A, the lower arm 126 of jack 120 has just come into contact with the let-off button 170. As repetition assembly (i.e., repetition support 110, jack 120, spring 160, regulating button 162, spoon 164 and repetition lever 202) continues to rotate upward from the "at rest" position, the top end surface 128 of jack upper arm 122 follows knuckle 150 upward and to the left (arrow 216), maintaining a rolling point of contact between jack top end surface 128 and knuckle 150. The clearance provided between regulating button 162 and spoon 164 in the "at rest" position leaves the jack upper arm 122 free to move to the left (in the orientation of the drawings) until either the regulating button 162 contacts spoon 164, or jack lower arm 126 contacts let-off button 170, whichever occurs first (depending upon adjustment, as discussed below).

Figure 6:
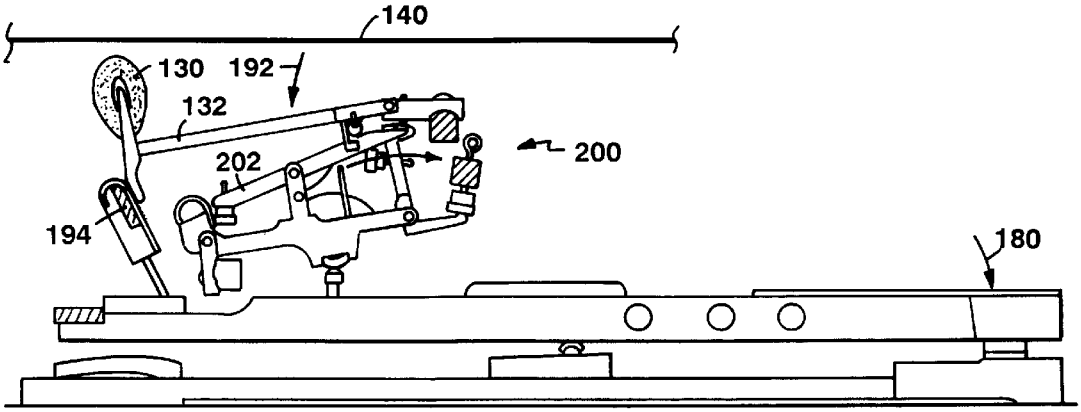
Figure 6A:
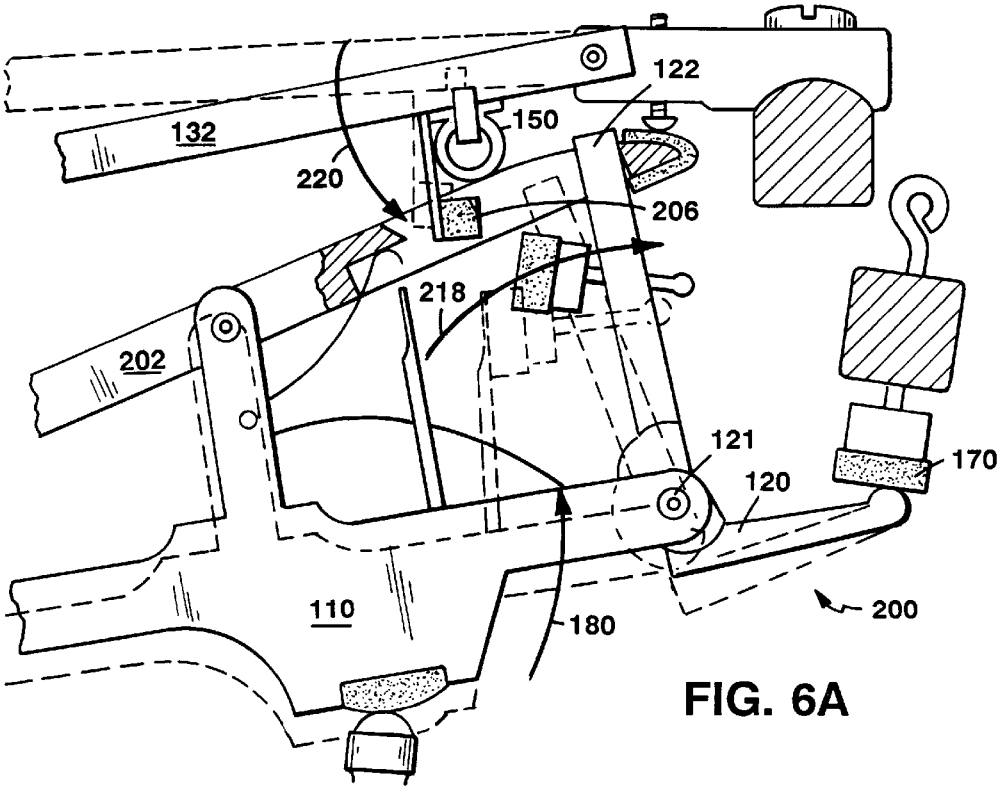

Finally, referring to FIGS. 6 and 6A (in which the position of the improved action 200 in FIG. 5A is indicated in dashed line for reference), as key depression continues (indicated by arrow 180), jack lower arm 126 presses against let off button 170, jack 120 is forced to rotate in a clockwise direction, about pin 121, thereby causing the top end surface 128 of the jack upper arm 122 to escape (arrow 218) from under knuckle 150. The hammershank 132, carrying hammer 130, is then free to rebound (arrow 220), after the hammer strikes the tensioned piano string 140, and to fall against back check 194.

When the key 102 is released, the improved piano escapement action 200 of the invention returns to the "at rest" position shown in FIGS. 4 and 4A, with regulating button 162 spaced from spoon 164 and the upper arm 122 of jack 120 urged (arrow 212) against retainer cushion 206 by return spring 160.

Referring now to FIGS. 8 through 16, we will now describe preferred embodiments of the invention, in which the jack 120 is held in its "at rest" position by engagement of the jack upper arm 122 against the jack retainer assembly 204, rather than by engagement of the regulating button 162 against spoon 164.

Figure 8A:
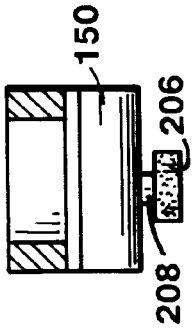
FIGS. 8 and 8A are side and end views of an embodiment of a hammershank of the invention.
Figure 8:
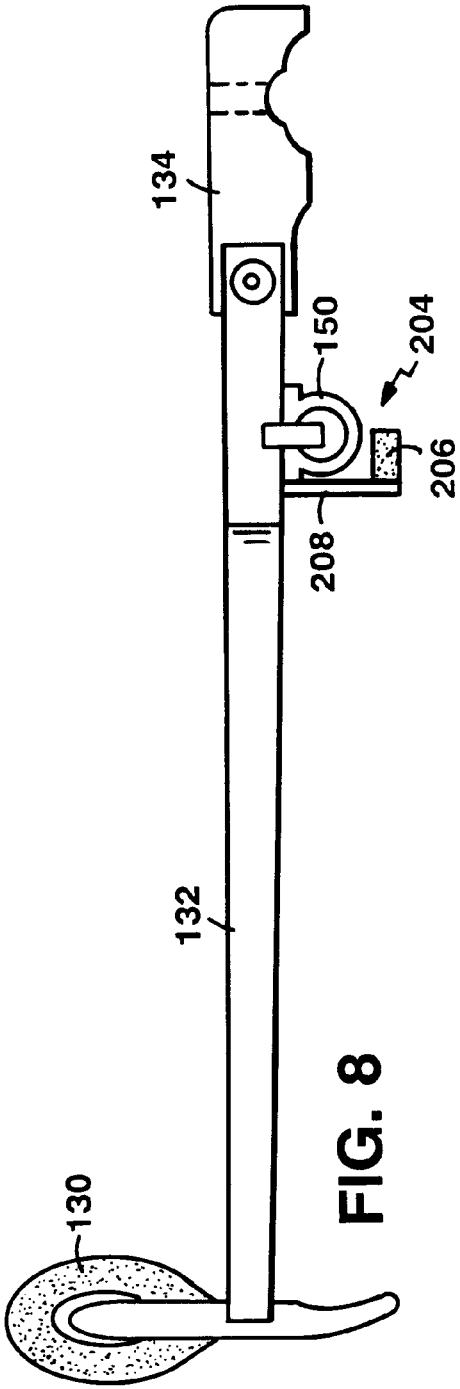

In the embodiment of FIGS. 8 and 8A, the jack retainer assembly 204 is shown in its simplest form, with a generally rectangular jack retainer cushion 206 held in place below the knuckle 150 by rigid support member 208 attached directly to hammershank 132.

Figure 9:
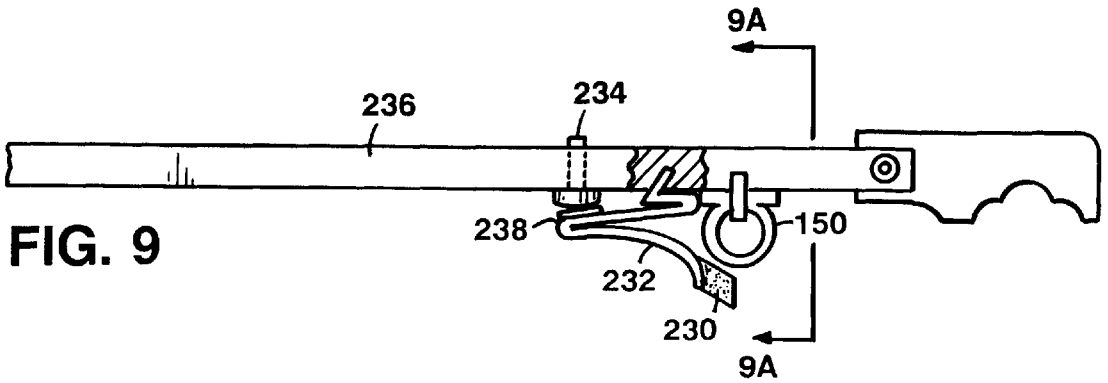
FIGS. 9 and 9A are side and end views of another embodiment of a hammershank of the invention.
Figure 9A:
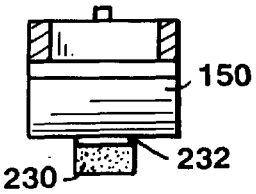

In the embodiment of FIGS. 9 and 9A, a retainer cushion 230 is affixed to adjustable support member 232. An adjustment screw 234 threaded through hammershank 236 has a head engaged with a pad 238 contacting support member 232. Rotation of screw 234 acts to adjust the position of the retainer cushion 230.

Figure 10:
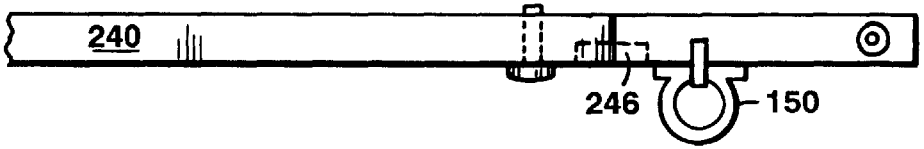
FIGS. 10 and 10A are side and bottom views of yet another embodiment of a hammershank of the invention.
Figure 10A:
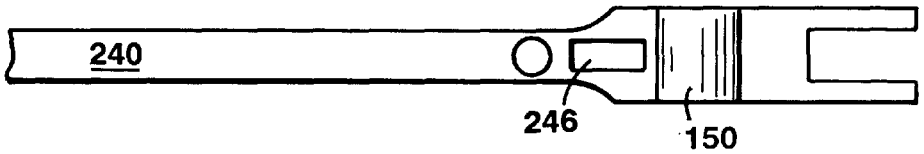
Figure 10B:
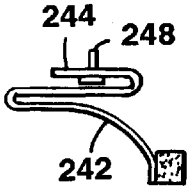
FIG. 10B is a side view of a pad support member of the hammershank of FIG. 10.

Referring to FIGS. 10, 10A and 10B, in improved hammershank 240, e.g. for use in the embodiment of the improved piano escapement action 200 of FIGS. 6 and 6A, flexible support member 242 has a rectangular end portion 244 that is secured in rectangular recess 246 defined by hammershank 240 by a fastener 248, e.g. a pin or screw.

Figure 11:
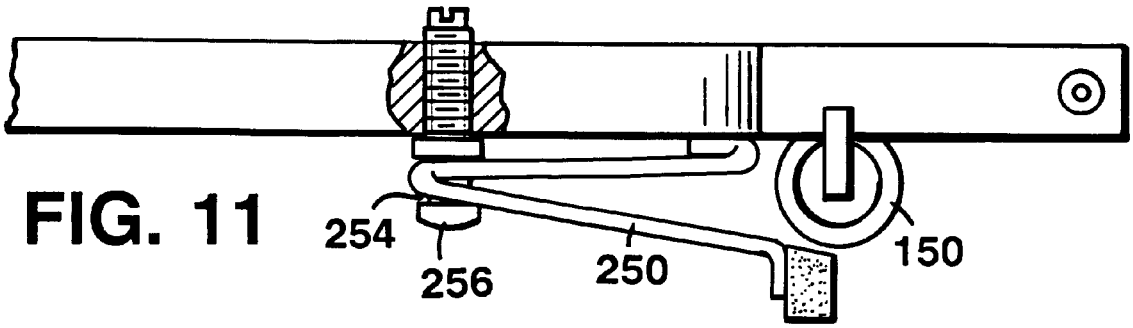
FIG. 11 is a side view of another embodiment of a hammershank of the invention with a slotted adjustment screw.
Figure 11B:
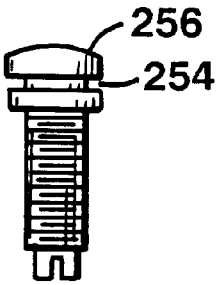
FIG. 11B a side view of the slotted adjustment screw.
Figure 11A:
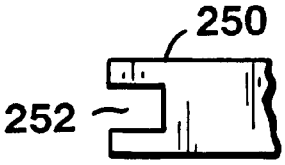
FIG. 11A is a top view of the flexible support member showing a forked depression.

In the embodiment of FIGS. 11 and 11A, an adjustable support member 250 is machined to include a fork-like depression 252 at the point of adjustment. The fork 252 is positioned within a slot 254 of collared adjustment screw 256, permitting both upward and downward adjustment. In FIG. 11B details of the construction of the adjustment screw 256 are shown.

Figures 7, 7A, 12, 12A, 13, 13A:
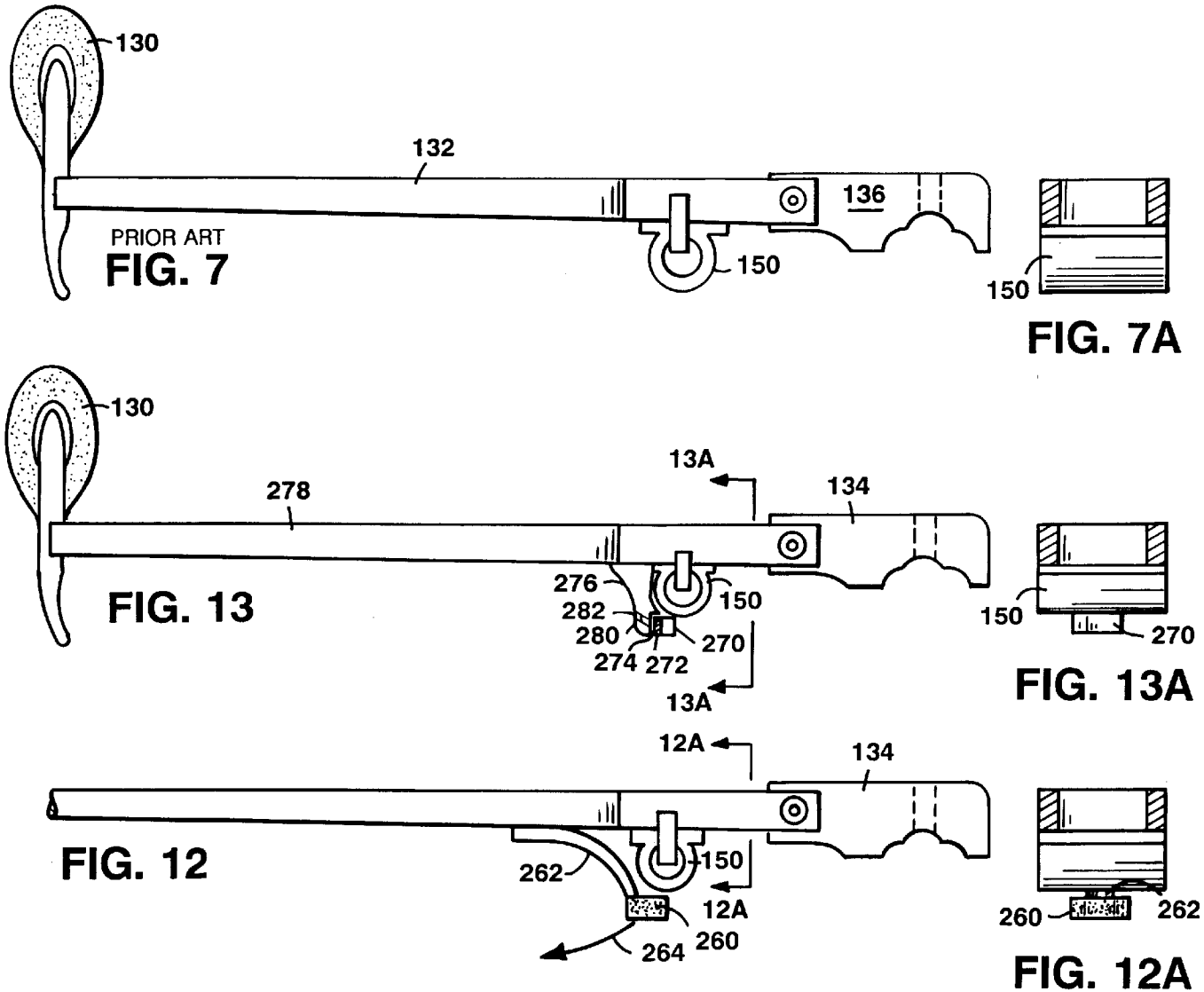
PRIOR ART FIG. 7
FIGS. 7 and 7A are side and end views, respectively, of a conventional prior art hammershank.
FIGS. 12 and 12A are side and end views of another embodiment of hammershank of the invention.
FIGS. 13 and 13A are side and end views of yet another embodiment of a hammershank of the invention.

In the embodiment of FIGS. 12 and 12A, a jack retainer cushion 260 is affixed to a relatively more malleable support member 262 formed, e.g., of soft metal, plastic or similar elastically deformable material. The flexible support member 262 is bent to reposition retainer cushion 260 along arc 264, which in turn allows for precise location of jack 120 relative to knuckle 150.

In the embodiment of FIGS. 13 and 13A, a jack retainer cushion 270 is affixed to a wooden button 272. The cushion and button are fitted into a recess 274 within a wooden support member 276 attached to hammershank 278, and held in place by a loop of elastic material 280 that fits within a groove 282 defined in support member 276. The position of cushion assembly 270, 272 can be finely regulated by inserting or removing shims or spacers between button 272 and support member 276.

Figure 14:
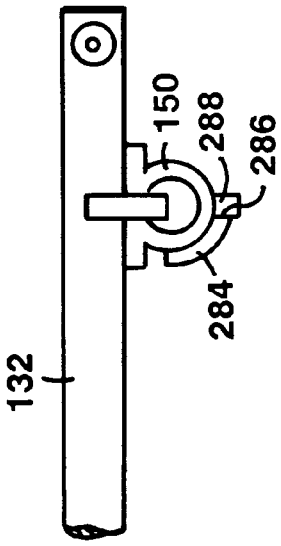
FIG. 14 is a side view of still another embodiment of a hammershank of the invention.

In the embodiment of FIG. 14, an extra layer 284, e.g. of buckskin or similar material, is affixed to knuckle 150, with an end face 286 of layer 284 acting as the support member for a jack retainer cushion 288.

Figure 15:
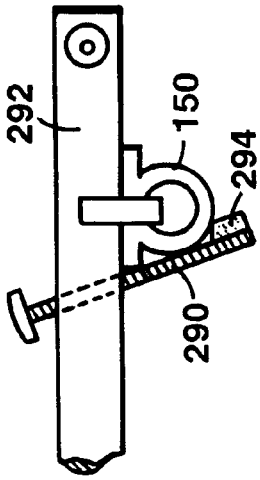
FIG. 15 s a side view of another embodiment of a hammershank of the invention.

In the embodiment of FIG. 15, a screw 290 extends through a hammershank 292. A jack retainer cushion 294 is affixed to the portion of screw 290 that extends below knuckle 150. The screw 290 is inserted into the hammershank 292 at an angle, so that raising and lowering the screw 290 adjusts the position of jack retainer cushion 294 relative to knuckle 150.

Figure 16:
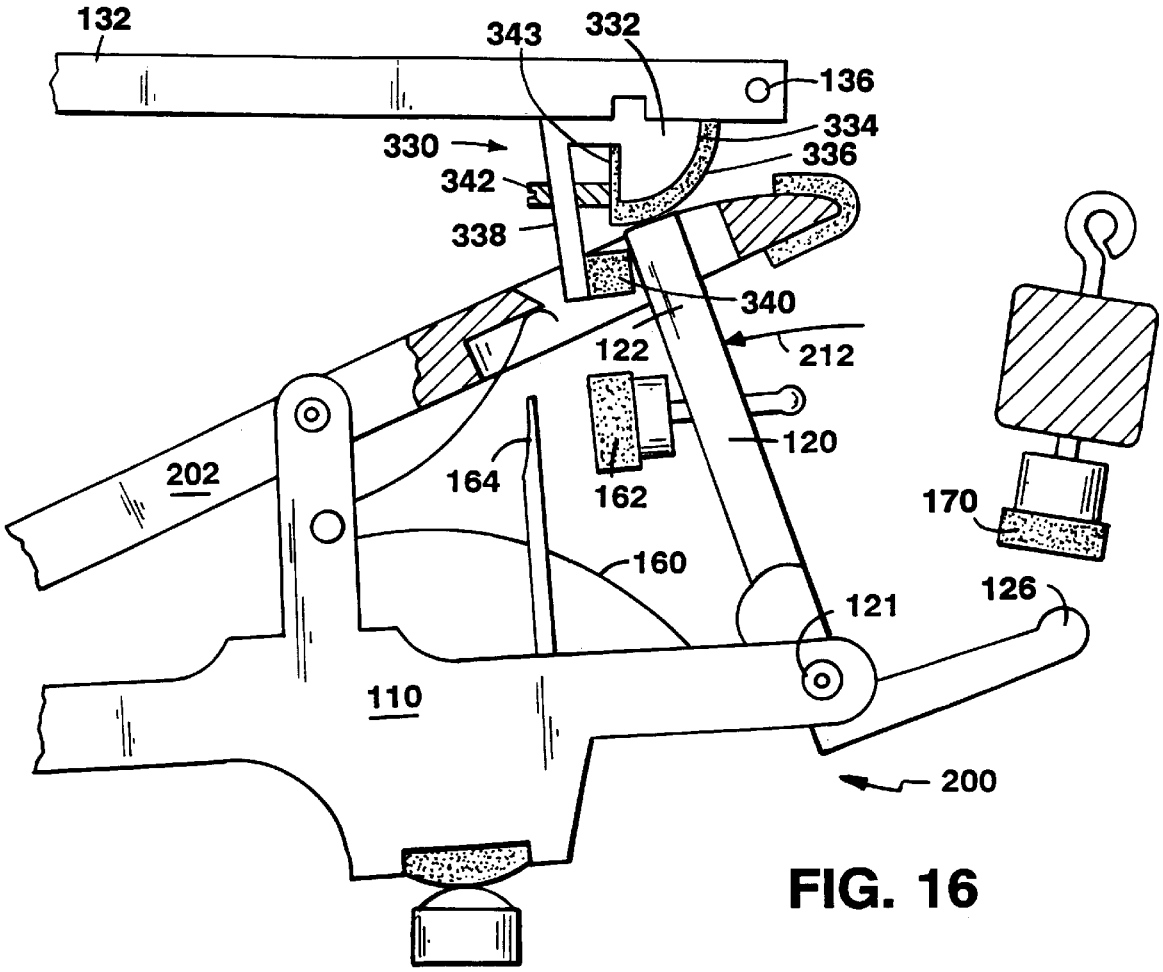
FIG.16 is a side view of another embodiment of an escapement action with a knuckle assembly of the invention.

In the embodiment of FIG. 16, a knuckle assembly 330 consisting of an integral knuckle and retainer includes a body 332 formed, e.g., of wood, defining a knuckle surface 334 having a cover 336 formed, e.g., of buckskin. A support member 338 formed, e.g., of wood or plastic, includes a retainer cushion 340, e.g., a felt pad. An adjustment screw 342 in threaded engagement with member 338 and bearing against the opposed surface 343 of body 332 is used to adjust the position of retainer cushion 340 relative to knuckle body 332. The cantilevered support member 338 is flexible enough to allow adjustment of the position of retainer cushion 340 on its free end, while maintaining enough rigidity to hold jack 120 in its "at rest" position (the required holding force being in the range of about 5 to 20 grams). Adjustment of the position of retainer cushion 340 is made, e.g., to compensate for compression of the retainer cushion over time and to align the retainer cushion during assembly of the escapement action. Knuckle assembly 330 is attached to hammershank 132 by, e.g., glue.

Other embodiments of the invention are within the following claims. For example, the relatively low compliance regulating button 162 and/or rigid spoon 164 of prior art escapement actions may be replaced with higher compliance components to allow jack 120 to follow the arcuate motion of knuckle 150.

Figure 18:
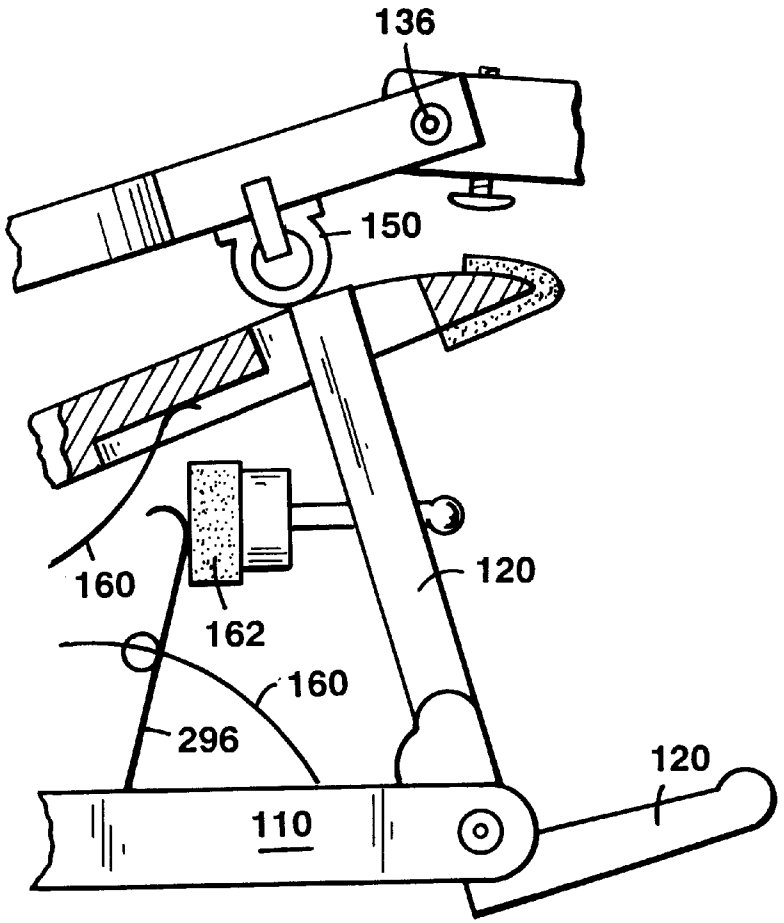
FIG. 18 is a similar view of another embodiment of an escapement action of the invention.
Figure 17:
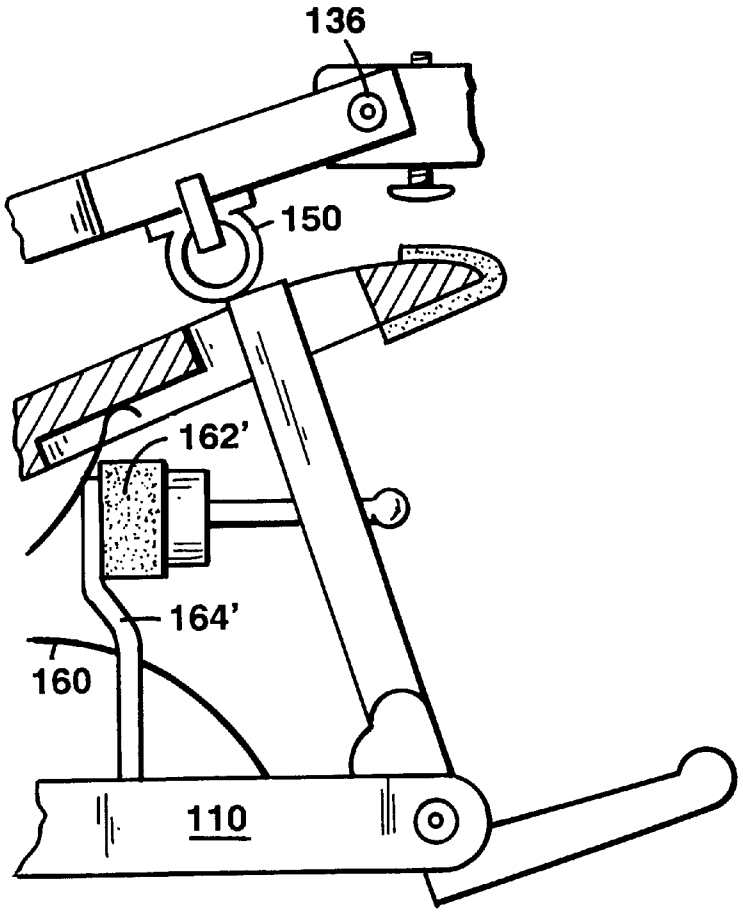
FIG. 17 a side view, taken partially in section, of an embodiment of an escapement action of the invention.
Figure 19:
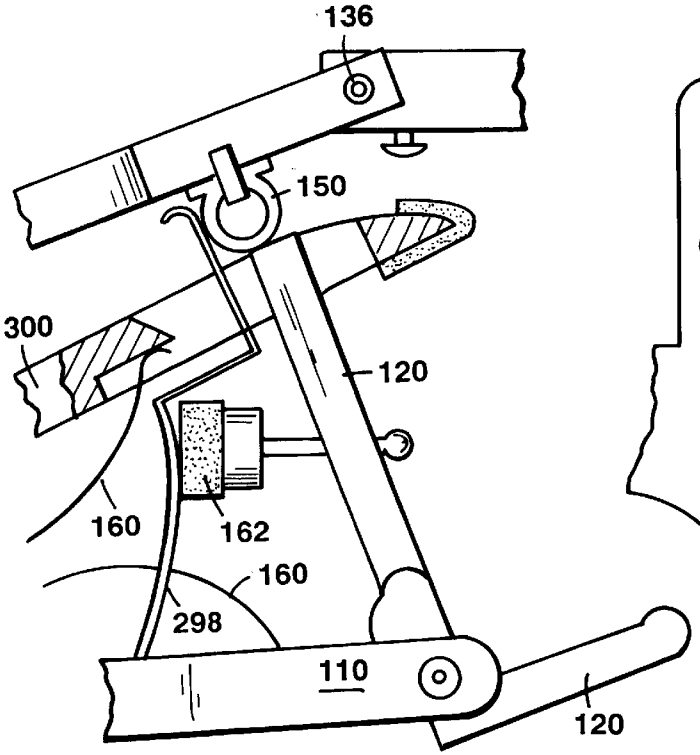
FIG. 19 is a similar view of yet another embodiment of an escapement action of the invention.

Also, referring to FIG. 17, a high compliance button 162' compresses against spoon 164' allowing the jack 120 to follow the knuckle 150; in FIG. 18, rigid spoon 164 is replaced with compliant spring member 296; and in FIG. 19, a spring member 298 extends through the repetition lever 300 and engages against the rear surface of knuckle 150, again leaving the jack 120 free to follow knuckle 150.

Figure 21:
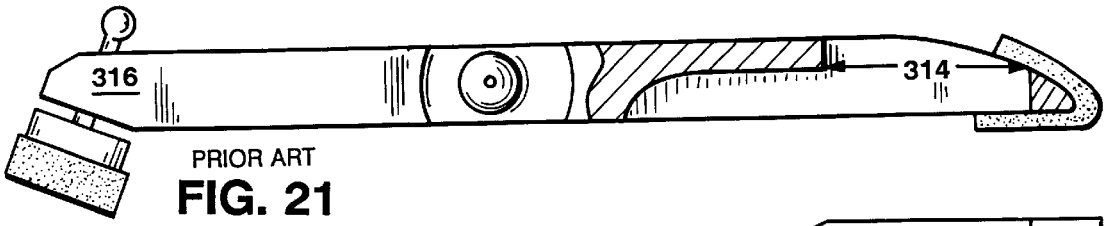
PRIOR ART FIG. 21
FIG. 21 is a side view, taken partially in section.
Figure 21A:
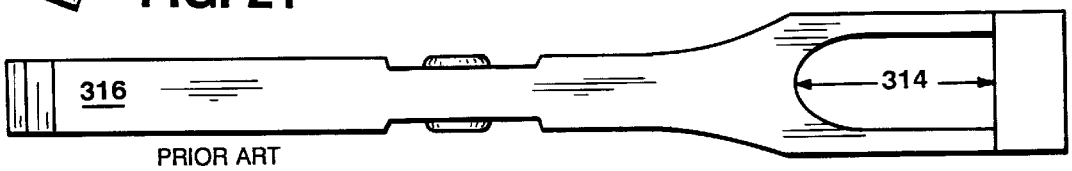
PRIOR ART FIG. 21A
FIG. 21A is a top view of a conventional prior art repetition lever.
Figure 20:
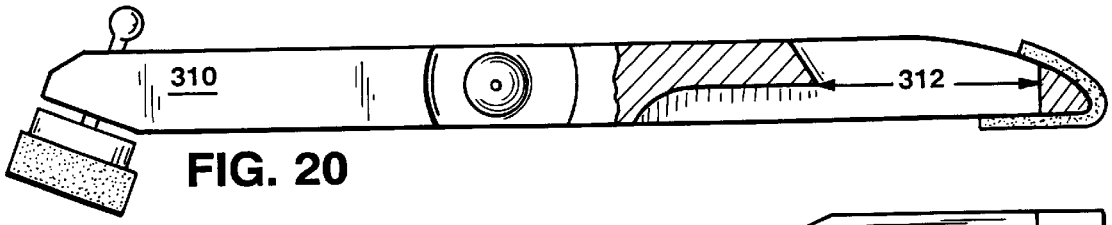
FIG. 20 is a side view, taken partially in section.
Figure 20A:
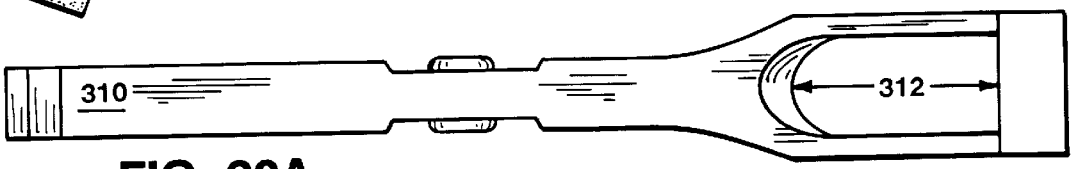
FIG. 20A is a top view of a repetition lever for use in a piano escapement action of the invention.

Also, referring to FIGS. 20 and 20A, an improved repetition lever 310 configured for use with the improved hammershank of FIGS. 8 through 16 has a slot dimension 312 that is extended and angled or stepped. This is in comparison to the corresponding slot dimension 314 of a conventional prior art repetition lever 316 (shown in FIGS. 21 and 21A).

Figure 23:
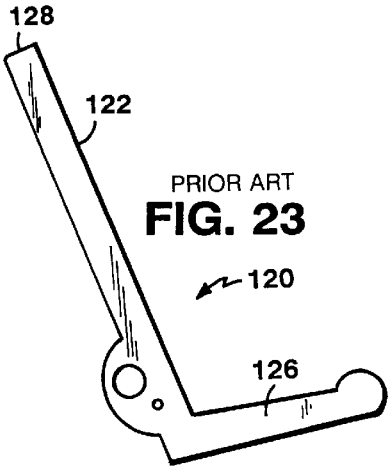
PRIOR ART FIG. 23
FIG. 23 is a view of a conventional prior art escapement jack.
Figure 23A:
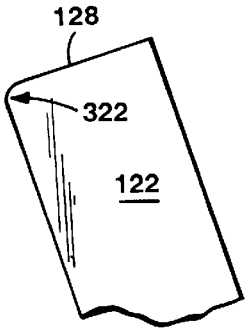
PRIOR ART FIG. 23A
FIG. 23A is a detail side view of the top end portion of the conventional prior art escapement jack of FIG. 23.
Figure 22:
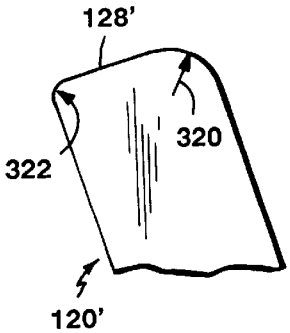
FIG. 22 is a detail side view of the top end portion of an improved escapement jack for use in a piano escapement action of the invention.

Referring now to FIG. 22, in a jack 120' for use in the improved action of the invention, the front upper corner of the top end surface 128' portion may have an enlarged radius 320 to allow jack top surface 128' to roll against knuckle 150. In contrast, referring to FIGS. 23 and 23A, top surface 128 of conventional jack 120 has a relatively smaller radius only at rear upper corner 322, to ease the return of upper arm 122 under knuckle 150 when the key is released.

Figure 24:
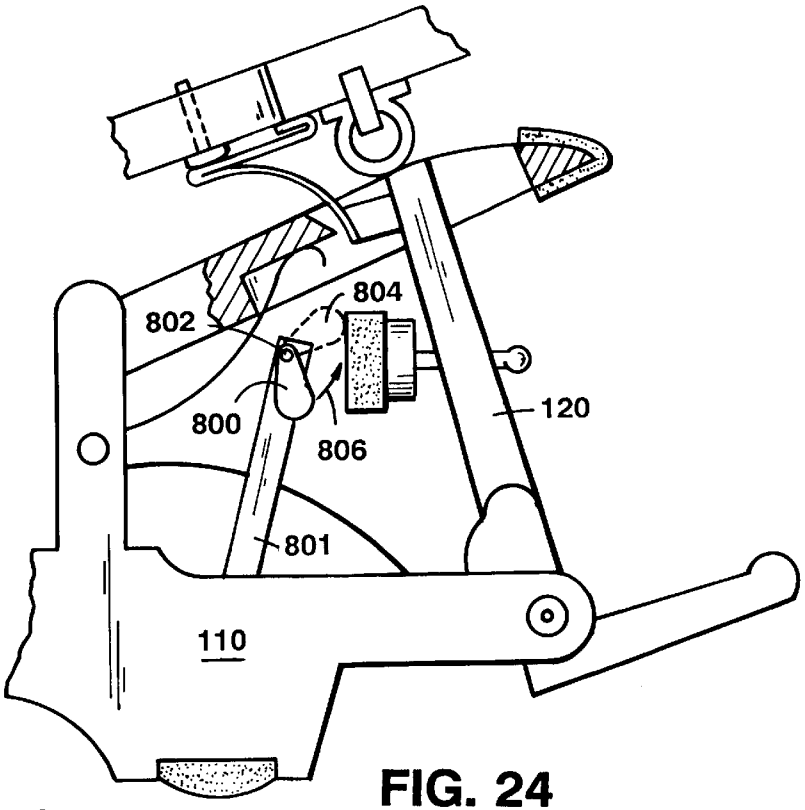
Figure 24A:
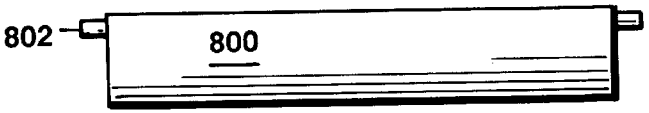
FIG. 24A is a plan view of a cam employed in the embodiment of the piano escapement action of the invention FIG. 24.

Referring to FIGS. 24 and 24A, a oval or elliptical cam 800, mounted between rigid supports 801 (only one is shown) on repetition support 110 is rotatable around pivot axis 802 to vary the space between regulating button 162 and the surface of cam 800, thus adjusting the point during the keystroke at which engagement between opposed surfaces of the jack and knuckle is initiated. If the space is larger, jack 120 will travel with knuckle 150, e.g., as described in FIGS. 4/4A through 6/6A. If the space is reduced by rotating cam 800 into position 804 (shown in dashed lines in FIG. 24), the action will function in a more conventional manner. Rotation (arrow 806) of the cam can be affected, e.g. by a pedal, finger lever or similar device connected to cam 800 by a flexible or rigid lever linkage.

Similarly, mechanisms for adjusting the location of spoon 164 may include, e.g., a rigid bar that moves (left to right in the orientation of the figures), activated by a flexible or rigid lever linkage.

Figure 25:
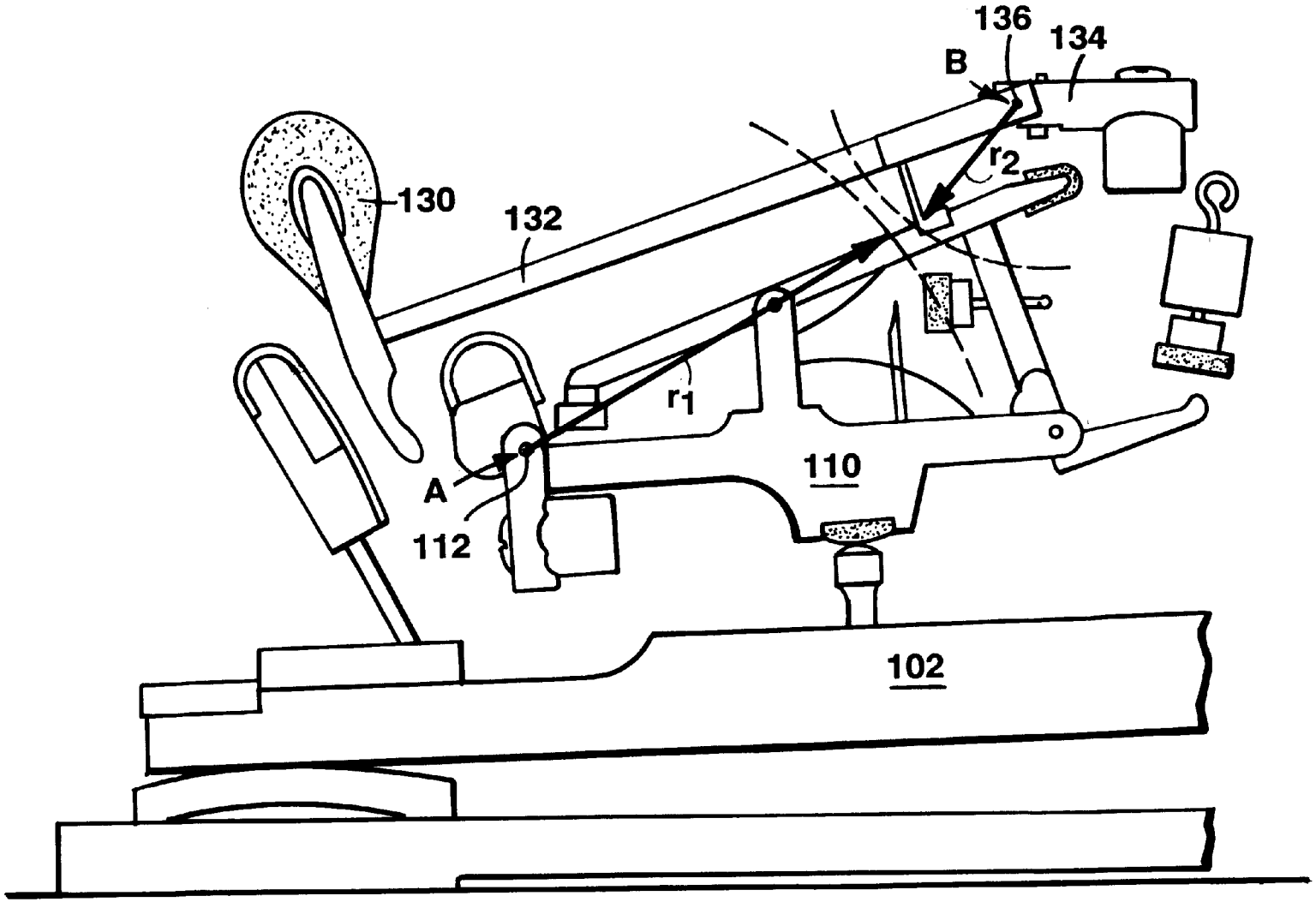
FIG. 25 is a side view of a piano escapement action of the invention.

Finally, referring to FIG. 25, where the repetition support lever has a first predetermined arc of travel, $r_1$, about a first center point 112 and the jack retainer assembly has a second predetermined arc of travel, $r_2$, about a second center point 136, the first and second predetermined arcs of travel are calculated relative to the length of a line, AB, between the first and second center points according to the equation:

$$r_1+r_2<AB$$

(where A=repetition support pivot, B=hammershank pivot, $r_1$=radius of repetition lever cut out arc, and $r_2$=radius of hammershank tab arc) to avoid interference engagement and to maximize performance aspects of the improved action.

What is claimed is:

1. A knuckle assembly for an escapement action of a piano, the escapement action comprising:

a hammershank having a first end mounted to pivot relative to the piano and a second end carrying a hammer to strike a tensioned string of the piano;

a repetition support bearing against a key of the piano and mounted to pivot relative to the piano in response to depression of the key;

a jack having a first portion extending from a pivot connection with said repetition support; and a spring urging said jack toward an "at rest" position;

a knuckle assembly for mounting between said first end and said second end of said hammershank, comprising:

a knuckle defining a knuckle surface for engagement with said jack, said knuckle arranged for escape of the jack from engagement with said knuckle surface during depression of a piano key;

a jack retainer for retaining the jack in the at rest position with said jack in engagement with said knuckle surface in opposition to force of the spring urging said jack toward the "at rest" position; and an adjustment means acting between said jack retainer and said knuckle for positioning said jack retainer relative to said knuckle.

2. The knuckle assembly of claim 1 wherein said adjustment means comprises an adjustment screw.

3. The knuckle assembly of claim 1 wherein said jack retainer includes a cushion surface positioned to retain said jack in the at rest position.

4. The knuckle assembly of claim 1 wherein said jack retainer comprises a flexible support member extending from said knuckle.

5. The knuckle assembly of claim 1 wherein said jack retainer and said knuckle comprise an integral component.

6. An escapement action for a piano, comprising:

a hammershank having a first end mounted to pivot relative to the piano and a second end carrying a hammer to strike a tensioned string of the piano;

a knuckle assembly disposed between said first end and said second end of said hammershank comprising a knuckle, a jack retainer, and an adjustment means acting between said jack retainer and said knuckle for positioning said jack retainer relative to said knuckle;

a repetition support bearing against a key of the piano and mounted to pivot relative to the piano in response to depression of the key;

a jack having a first portion extending from a pivot connection with said repetition support and defining a jack surface disposed for engagement with a knuckle surface of said knuckle, said jack arranged for escape of said jack surface from engagement with said knuckle surface during depression of said key; and a spring urging said jack toward an at rest position with said jack surface in engagement with said knuckle surface;

said jack retainer position being adjustable to retain said jack in the "at rest" position in opposition to force of said spring.

7. The piano escapement action of claim 6 wherein said adjustment means comprises an adjustment screw.

8. The piano escapement action of claim 6 wherein said jack retainer includes a cushion surface positioned to retain said jack in the at rest position.

9. The piano escapement action of claim 6 wherein said jack retainer comprises a flexible support member extending from said knuckle.

10. The piano escapement action of claim 6 wherein said jack retainer and said knuckle comprise an integral component.

11. A piano escapement action assembly, comprising:

a hammershank having a first end mounted to a piano for pivoting movement and a second end carrying a hammer to strike a string;

a knuckle assembly disposed between said first end and said second end of said hammershank comprising a knuckle, a jack retainer, and an adjustment means acting between said jack retainer and said knuckle for positioning said jack retainer relative to said knuckle;

a jack having a jack surface in engagement with a knuckle surface of said knuckle in an at rest position, said jack being arranged relative to said knuckle and to a key of the piano to convey motion of the key to said knuckle, and to disengage said jack surface from said knuckle surface during depression of the key; and a spring disposed to urge said jack toward the at rest position;

said jack retainer position being adjustable to oppose said spring to retain said jack in the "at rest" position, and allowing said jack, in response to depression of the key, to move in a coupled rotary motion with said knuckle assembly prior to disengagement of said jack surface from said knuckle surface to allow said jack surface engaged with said knuckle surface to remain engaged with said knuckle surface during movement of said knuckle.

12. The piano escapement action assembly of claim 11 wherein said adjustment means comprises an adjustment screw.

13. The piano escapement action assembly of claim 11 wherein said jack retainer includes a cushion surface positioned to retain said jack in the at rest position.

14. The piano escapement action assembly of claim 11 wherein said jack retainer comprises a flexible support member extending from said knuckle.

15. The piano escapement action assembly of claim 11 wherein said jack retainer and said knuckle comprise an integral component.

16. The piano escapement action assembly of claim 11, further comprising:

a repetition support lever;

a relatively rigid spoon mounted for movement with said repetition support lever; and a regulating button mounted for movement with said jack;

said spoon and said regulating button disposed at spaced apart positions in the at rest position of said jack.

17. The piano escapement action assembly of claim 16, wherein said repetition support lever has a first predetermined arc of travel about a first center point and said jack retainer assembly has a second predetermined arc of travel about a second center point, and said first and second predetermined arcs of travel are calculated relative to spacing between said first and second center points to avoid interference engagement.

18. The piano escapement action assembly of claim 11, further comprising:

an adjustable regulating member mounted for movement between a first position allowing rotation and following of said jack, and a second position restricting movement of said jack prior to disengagement.

19. The piano escapement action assembly of claim 11, wherein said jack retainer is mounted to maintain a rolling point of engagement of said jack surface with said knuckle surface, thereby to minimize sliding friction between said jack surface and said knuckle surface during a portion of the movement of said action before said disengagement.

20. An escapement action for a piano, comprising:

a hammershank having a first end mounted to pivot relative to the piano and a second end carrying a hammer to strike a tensioned string of the piano, said hammershank comprising a knuckle disposed thereal-ong between said first and said second end;

a repetition support bearing against a key of the piano and mounted to pivot relative to the piano in response to depression of the key;

a jack pivotally connected to said repetition support and defining a jack surface disposed for engagement with a knuckle surface of said knuckle, said jack arranged for escape of said jack surface from engagement with said knuckle surface during depression of said key;

a spring urging said jack toward an "at rest" position with said jack surface in engagement with said knuckle surface; and a jack retainer assembly disposed on said hammershank between said second end and said knuckle, said jack retainer assembly including an adjustment means acting between said jack retainer and said knuckle for positioning said jack retainer relative to said knuckle.

* * * * *